US007946261B2

(12) United States Patent
Sfaxi et al.

(10) Patent No.: US 7,946,261 B2
(45) Date of Patent: May 24, 2011

(54) ELECTROMAGNETIC ACTUATOR WITH TWO ELECTROMAGNETS COMPRISING MAGNETS HAVING DIFFERENT FORCES AND METHOD OF CONTROLLING AN INTERNAL COMBUSTION ENGINE VALVE USING SAME

(75) Inventors: Mahmoud Sfaxi, Paris (FR); Emmanuel Talon, Verneuil sur Seine (FR)

(73) Assignee: Valeo Systemes de Controle Moteur, Cergy Pontoise Cedex (FR)

( * ) Notice: Subject to any disclaimer, the term of this patent is extended or adjusted under 35 U.S.C. 154(b) by 429 days.

(21) Appl. No.: 12/091,766

(22) PCT Filed: Nov. 30, 2006

(86) PCT No.: PCT/FR2006/002622

§ 371 (c)(1),
(2), (4) Date: Apr. 28, 2008

(87) PCT Pub. No.: WO2007/063222

PCT Pub. Date: Jun. 7, 2007

(65) Prior Publication Data

US 2008/0276889 A1 Nov. 13, 2008

(30) Foreign Application Priority Data

Dec. 2, 2005 (FR) ..... 05 12235

(51) Int. Cl.
*F01L 9/04* (2006.01)

(52) U.S. Cl. ..... 123/90.11; 251/129.16

(58) Field of Classification Search ..... 123/90.11; 251/129.16, 129.15; 335/255, 256, 251, 335/253, 229; 310/14
See application file for complete search history.

(56) References Cited

U.S. PATENT DOCUMENTS 6,763,789 B1 * 7/2004 Liang et al. ..... 123/90.11
(Continued)

FOREIGN PATENT DOCUMENTS

DE 100 03 928 A1 6/2001
(Continued)

OTHER PUBLICATIONS

International Search Report from PCT/FR2006/002622 mailed Apr. 11, 2007 (6 pages).

*Primary Examiner* — Thomas E Denion
*Assistant Examiner* — Daniel A Bernstein
(74) *Attorney, Agent, or Firm* — Osha Liang LLP

(57) ABSTRACT

An electromagnetic actuator including an actuating member associated with an armature and able to move between two extreme positions under the action of an elastic member and two electromagnets that attract the armature to one of the extreme positions, where the electromagnets each include a coil, a core for channeling a flux of the coil so that it forms a return path in the armature, and permanent magnets associated with the core so that the latter channels a flux of the permanent magnets so that it forms a return path in the armature, where the permanent magnets of one of the electromagnets exert a force on the armature sufficient to retain the armature in the associated extreme position against the springs, and where the permanent magnets of the other electromagnet exerts a force on the armature insufficient to retain the armature in the associated extreme position against the springs.

4 Claims, 3 Drawing Sheets

U.S. PATENT DOCUMENTS

| | | | | |
|---|---|---|---|---|
| 7,124,720 | B2 * | 10/2006 | Liang et al. | 123/90.11 |
| 7,156,057 | B2 * | 1/2007 | Lecrivain et al. | 123/90.11 |
| 7,249,579 | B2 * | 7/2007 | Liang et al. | 123/90.11 |
| 7,584,727 | B2 * | 9/2009 | Liang et al. | 123/90.11 |
| 2004/0217313 | A1 | 11/2004 | Sedda et al. | |
| 2005/0166873 | A1 * | 8/2005 | Morin et al. | 123/90.11 |
| 2005/0211199 | A1 * | 9/2005 | Liang et al. | 123/90.11 |
| 2005/0211200 | A1 * | 9/2005 | Liang et al. | 123/90.11 |
| 2005/0279300 | A1 * | 12/2005 | Liang et al. | 123/90.11 |
| 2007/0131185 | A1 * | 6/2007 | Liang et al. | 123/90.11 |

FOREIGN PATENT DOCUMENTS

| | | | |
|---|---|---|---|
| DE | 10003928 | A1 * | 6/2001 |

* cited by examiner

ELECTROMAGNETIC ACTUATOR WITH TWO ELECTROMAGNETS COMPRISING MAGNETS HAVING DIFFERENT FORCES AND METHOD OF CONTROLLING AN INTERNAL COMBUSTION ENGINE VALVE USING SAME

The invention relates to an electromagnetic actuator with two electromagnets comprising magnets generating different forces and to a method of controlling an internal combustion engine valve using said actuator.

BACKGROUND OF THE INVENTION

Electromagnetic actuators comprising an actuating member associated with an armature that can move between two extreme positions under the action of two electromagnets each comprising a coil and a core designed to channel a flux of the coil, so that it forms a return path in the armature, are known.

Such an actuator is for example used to actuate an internal combustion engine valve, the actuator being placed in such a way that the pushrod extends along the slide axis of the valve. The actuators are energized so that the armature is attracted selectively. The end of the pushrod and the end of the valve are brought back against one another by opposing springs that define an equilibrium position of the pushrod/valve assembly substantially at mid-path between the two electromagnets. The extreme positions of the armature are defined by the armature butting against the electromagnets and correspond to a closed position and to an open position of the valve respectively.

Each of the electromagnets includes permanent magnets that are incorporated into the core in such a way that the latter channels a flux of the permanent magnets so that it forms a return path in the armature. The permanent magnets serve to retain the armature in abutment on the corresponding core against the springs when the corresponding coil is not energized.

However, in case of a failure of the coil of the electromagnet returning the armature to the extreme position corresponding to the open position of the valve while the armature is kept against this electromagnet by the associated permanent magnets, it is then impossible for the armature to separate from the core and therefore to dislodge the valve from the open position.

The locking of a valve in the open position is a problem since, when the other valve of the same cylinder is opened, the valve short-circuits the intake circuit and the exhaust circuit of the engine, thereby preventing the engine from operating.

On the other hand, the locking of a valve in the closed position does not cause such a short circuit and the engine can continue to operate on the other cylinders.

It has been considered to use, for the electromagnet corresponding to the open position, an electromagnet having no permanent magnets, so as to prevent any locking of the armature in the extreme position corresponding to the open position of the valve. However, such an arrangement results in an unbalanced actuator, which is difficult to regulate.

This is because, for that one of the electromagnets that does not include permanent magnets, the retention of the armature against the corresponding core takes place without the coil being energized.

In contrast, for that one of the electromagnets that does not include permanent magnets, the retention of the armature against the core requires the coil to be energized so that it generates a flux equivalent to the magnets of the other electromagnet, that is to say a large flux.

The dissymmetry in the flux lines during retentions gives rise to regulating difficulties.

It has also been considered to offset the elastic member in such a way that the latter exerts a larger force when the valve is in the open position than when the valve is in the closed position. However, this offset gives rise to severe shocks when the armature butts on one of the electromagnets, which situation is unacceptable.

SUBJECT OF THE INVENTION

The subject of the invention is an electromagnetic actuator that does not allow uncontrolled retention of the valve in the open position, while reducing the magnetic imbalance.

BRIEF DESCRIPTION OF THE INVENTION

To achieve this objective, what is proposed is an electromagnetic actuator comprising an actuating member associated with an armature and able to move between two extreme positions under the action of an elastic member and of two electromagnets that are designed to attract the armature to one of the extreme positions, said electromagnets each comprising: a coil; a core designed to channel a flux of the coil so that it forms a return path in the armature; and one or more permanent magnets associated with the core so that the latter channels a flux of the permanent magnets so that it forms a return path in the armature. According to the invention, the permanent magnet or magnets of one of the electromagnets are designed to exert a force on the armature sufficient to retain the armature on the associated core against the elastic member, whereas the permanent magnet or magnets of the other of the electromagnets are designed to exert a force on the armature insufficient to retain the armature on the associated core against the elastic member.

Thus, by arranging the electromagnets in such a way that the electromagnet having the permanent magnets of lower force corresponds to the open position of the valve, the retention of the valve in the open position being possible only if the coil in question is energized in order to supply the magnets with the flux supplement needed to retain the armature. In the event of the coil failing, although the armature is in abutment on the core, the permanent magnets do not have the force to retain the armature against the return springs so that the armature separates from the latter and the valve moves to the closed position.

It is thus impossible for the valve to be locked in the open position.

The presence of the permanent magnet of low force tends to rebalance the dissymetric action of the two electromagnets so that the actuator is much easier to regulate. This is because, for that one of the electromagnets having the magnets of low force, retention of the armature requires only a small flux supplement. This flux supplement is much smaller than the flux that would be necessary in the absence of a magnet for retaining the armature.

BRIEF DESCRIPTION OF THE DRAWINGS

The invention will be better understood in the light of the following description with reference to the figures of the appended drawings in which.

DETAILED DESCRIPTION OF THE INVENTION

Figure 1:
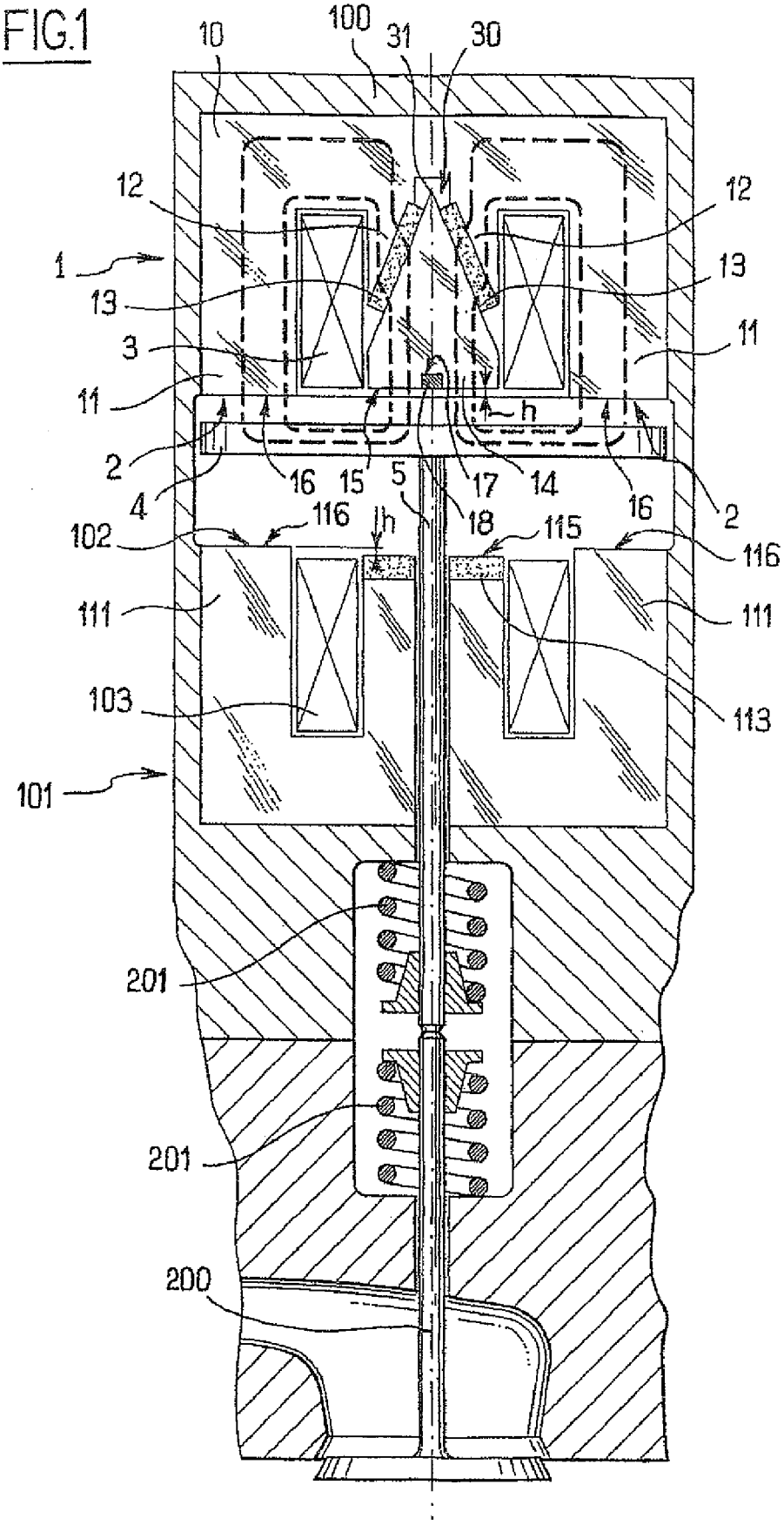
FIG. 1 is a partial schematic sectional view of an actuator according to the invention.

Referring to FIG. 1, the electromagnetic actuator of the invention comprises an upper electromagnet 1 with a core 2 and a coil 3. The electromagnet 1 exerts, in a controlled manner, an electromagnetic force on an armature 4 fastened to a pushrod 5 that can move along the X axis.

Such an actuator is for example used for actuating an internal combustion engine valve 200, the actuator being placed in such a way that the pushrod 5 lies along the slide axis of the valve. The actuator includes another electromagnet 101 that lies opposite the electromagnet 1 in order for the armature 4 to be selectively attracted in the other direction. The end of the pushrod 5 and the end of the valve 200 are brought back together by opposing springs 201 that define an equilibrium position of the pushrod/valve assembly at approximately mid-path between the two electromagnets.

The armature 4 can move between two extreme positions defined by the armature when butted on the cores 2 and 102 respectively. These extreme positions correspond to the closed position and the open position of the valve 200 respectively.

The core 2 of the electromagnet 1 has a base 10 on which two lateral branches 11 and a central branch extend, the coil 3 lying around said central branch. The central branch comprises two portions 12 with oppositely inclined faces that are integral with the base 10. The portions 12 form a support part for the core 2, said part being designed to accommodate permanent magnets 13 in such a way that they lie obliquely to the X axis and form a V, the point of which here is turned toward the base 10. Extending in the V thus formed is a wedge 14 forming an end part of the central branch.

The path of the flux lines generated by the permanent magnets 13, which pass through the core 2 so as to form a return path in the armature 4, is indicated by the bold dashed lines in FIG. 1. The wedge 14 has an end face 15 in which a groove 17 lies parallel to the permanent magnets 13. The groove 17 ensures that there is a clear separation between the respective flux lines of the two permanent magnets 13 that pass on either side of the groove 17.

The actuator includes a lower electromagnet 101 that has a core 102 and a coil 103 lying around a central branch of the core, extending from a base 110 of the latter. The core 102 also includes lateral branches 111.

A permanent magnet 113 lies on the end of the central branch (the pushrod 5 passing through said magnet).

The flat arrangement of the permanent magnet 113 in the lower electromagnet gives it a shorter length than the combined length of the V-configured permanent magnets 13 of the upper electromagnet, in such a way that the flat permanent magnet 113 is able to exert, on the armature 4 when the latter is in abutment on the lower electromagnet 101, only a force smaller than that exerted by the V-configured permanent magnets 13 when the armature 4 is in abutment on the upper electromagnet 1.

The magnets are chosen in such a way that the V-configured permanent magnets 13 are capable by themselves of retaining the armature 4 in abutment on the upper electromagnet 1 against the springs 201, whereas the flat permanent magnet 113 is incapable by itself of retaining the armature 4 in abutment on the lower electromagnet 101 against the springs 201.

Thus, the armature 4 can be retained against the upper electromagnet 1 without the coil 3 being energized, thereby contributing to a reduction in the consumption of the actuator. However, to retain the armature 4 in abutment on the lower electromagnet, it is necessary for the coil 103 to be energized so that it generates a flux supplementary to the flux of the flat permanent magnet 113. In the event of the coil 103 failing while the armature 4 is in abutment on the lower electromagnet 101, the armature 4 is not retained so that the valve cannot be locked in the open position.

In practice, the actuator will be dimensioned so that this flux supplement remains small compared with the flux of the flat permanent magnet 113 and is of the same order of magnitude as the adverse flux that the coil 3 must generate in order to counter the flux of the V-configured permanent magnets 13 when the armature 4 has to separate from the upper electromagnet 1.

Thus, although due precisely to the difference in flux intensity of the permanent magnets with which the two electromagnets are equipped, the dynamic behavior of the actuator is imbalanced, this imbalance, remains within limits, allowing the actuator to be easily regulated.

According to one particular aspect of the invention, the end face 15 of the wedge 14 lies set back by an amount h from the end faces 16 of the lateral branches 11.

Thus, when the armature 4 butts on the core 2, it butts only on the end faces 16 of the lateral branches 11 and not on the central branch. In general, and more particularly when the permanent magnets are produced by sintering powdered materials, the permanent magnets are very sensitive to shocks. The set-back h protects the V-configured permanent magnets 13 from the shocks of the armature 2 against the core 4, thereby increasing the lifetime of the actuator.

Furthermore, in the absence of such a set-back, the manufacturing tolerances on the core would give rise to residual gaps between the armature and the branches of the actuator, causing a magnetic hysteresis which would disturb the repeatability of the separation of the armature 4 from the core 2. The set-back makes it possible for this hysteresis to be reduced, or even eliminated. For this purpose, it is preferred to choose a set-back h of the order of a few tenths of a millimeter, and therefore much larger than the gaps, which are of the order of a few tens of microns so that the set-back h forms, between the armature and the central branch, a large gap, the influence of which is predominant on that one of the residual gaps when the armature is close to the core, thereby making it possible to reduce, or even eliminate, the effects of the magnetic hysteresis caused by the residual gaps.

In practice, it will be preferable to choose a set-back h of greater than 0.1 millimeters, while still remaining less than 0.35 millimeters, so as not to prejudice the performance of the actuator.

Likewise, the end face 115 of the central branch of the core 102 lies set back by an amount h relative to the end faces 116 of the lateral branches 111.

Figure 2:
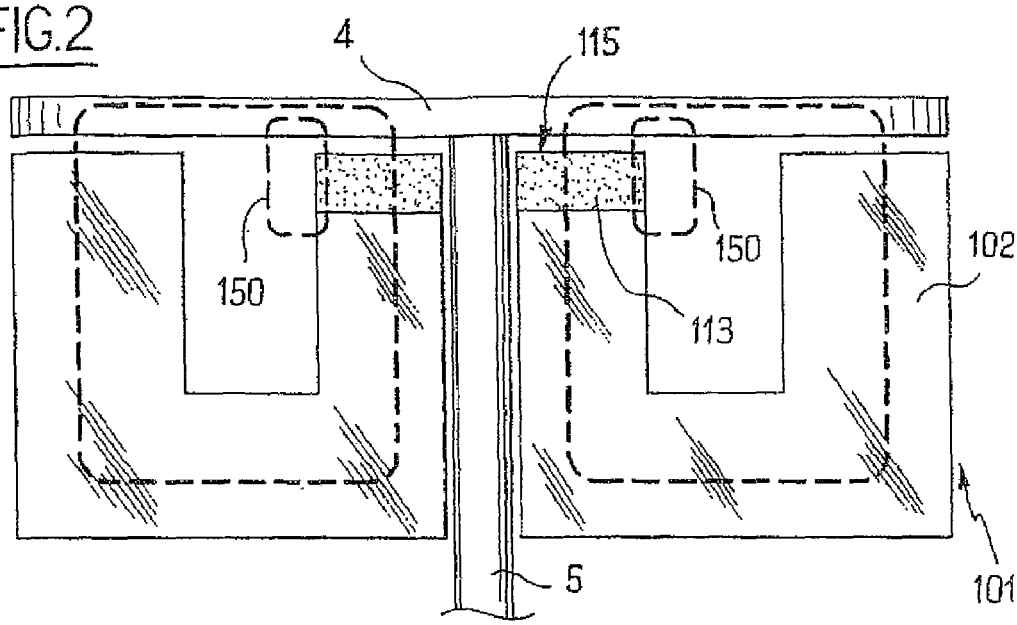
FIG. 2 is a schematic front view of the lower electromagnet with which the actuator of FIG. 1 is equipped.

In this regard, and as is more precisely illustrated in FIG. 2, the end face 115 of the central branch of the lower core here is formed by one of the faces of the permanent magnet 113 which is placed on the end of the central branch.

The arrangement of the permanent magnet 113 on the end of the branch is particularly advantageous, since the end flux lines 150 generated by the permanent magnet 113 may thus form, at least partly, a return path in the armature 4 when the latter is close to the lower electromagnet 101, as is immediately apparent in FIG. 2.

Figure 3:
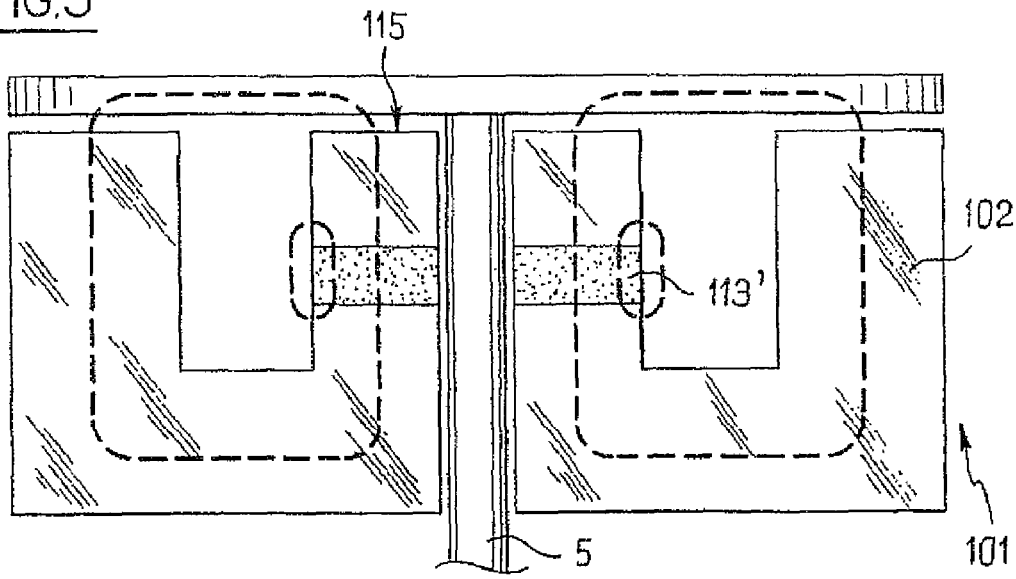
FIG. 3 is a view similar to FIG. 2 of an alternative embodiment.

For comparison, FIG. 3 illustrates an arrangement in which the permanent magnet 113' is located somewhere around the middle of the central branch. It may be seen that the end flux lines 150' cannot form a return path in the armature 4, even it the latter is close to the lower electromagnet 101.

Figure 4:
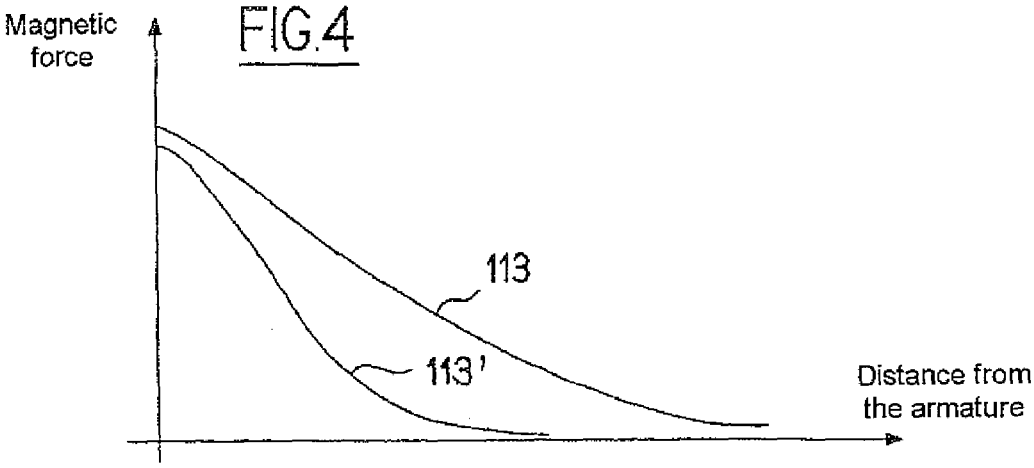
FIG. 4 is a graph comparing the magnetic force developed by the permanent magnets with which the lower electromagnets illustrated in FIGS. 2 and 3 are equipped as a function of the distance separating the armature from the lower electromagnet.

As illustrated in FIG. 4, the magnetic force generated by the permanent magnet 113 when the armature is in abutment on the core 102 of the lower electromagnet 101 is slightly larger than the force generated by the magnet 113' under the same conditions. The permanent magnet 113 is thus slightly more effective.

Furthermore, the magnetic force generated by the permanent magnet 113 when the armature 4 is away from the core 102 of the lower electromagnet 101 decreases less quickly than the force generated by the magnet 113' under the same conditions. This allows the armature 4 to be better retained when it leaves the lower electromagnet 102 and contributes even more to making the behavior of the actuator less imbalanced.

According to another particular aspect of the invention, it will be advantageous to maximize the area 115 of the permanent magnet 113 facing the armature 4, in order to avoid any flux concentration which would induce an excessively large retention force. In particular, it is recommended not to reduce this area, for example for the purpose of installing a clamp for retaining the permanent magnet 113 on the core 102.

To fix the permanent magnet 113 to the core 102, the permanent magnet 113 may therefore be bonded directly to the end of the central branch, thereby leaving the end surface 115 completely free.

Figure 5:
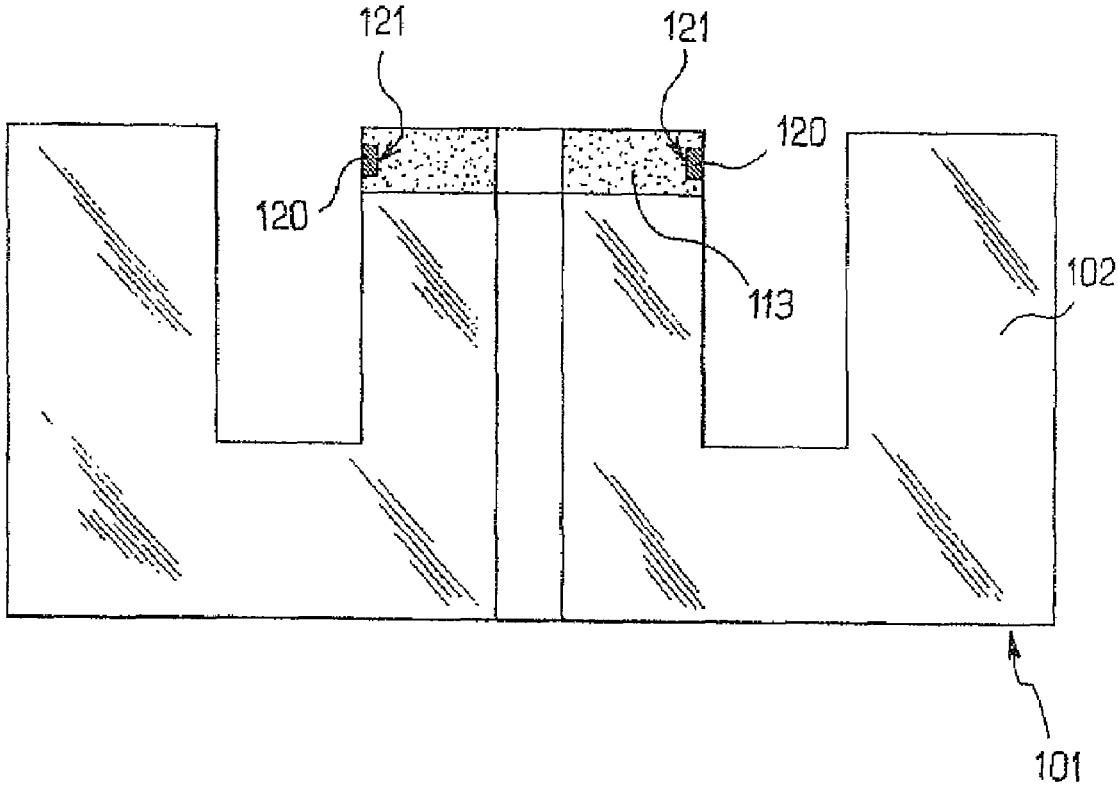
FIG. 5 is a partial front view of the core of a lower electromagnet with which an actuator according to one particular embodiment of the invention is equipped.

According to a variant, illustrated in FIG. 5, clamps 120 may be used which are inserted into grooves 121 on the edges of the permanent magnet. This also leaves the end surface 115 entirely free.

The invention is not limited to what has just been described, but quite on the contrary it encompasses any variant thereof that falls within the scope defined by the claims.

In particular, although actuators have been illustrated here in which the permanent magnets form a V the point of which is turned toward the base of the core, it will also be possible to place the magnets in such a way that they form a V with the point directed toward the armature. The support parts for the magnets integral with the base will have inclined faces that are no longer facing each other, but are turned toward the lateral branches, whereas the end part of the central branch will no longer have a wedge shape, but a hat shape.

More generally, the arrangement of the actuator with an upper electromagnet having permanent magnets in a V configuration and a lower electromagnet with a flat magnet is not limiting, and the invention covers any arrangement in which the permanent magnet or magnets of one of the electromagnets are designed to exert a force on the armature sufficient to retain the armature on the associated core against the springs, whereas the permanent magnet or magnets of the other of the electromagnets are designed to exert a force on the armature insufficient to retain the armature on the associated core against the springs.

The invention claimed is:

1. An electromagnetic actuator comprising an actuating member associated with an armature and able to move between two extreme positions under the action of an elastic member and of two electromagnets that are designed to attract the armature to one of the extreme positions, said electromagnets each comprising:

a coil;

a core configured to channel a flux of the coil so that the core forms a return path in the armature; and at least one permanent magnet associated with the core so that the latter channels a flux of the permanent magnets so that the core forms a return path in the armature, wherein the at least one permanent magnet of one of the electromagnets is configured to exert a force on the armature sufficient to retain the armature in the associated extreme position against the springs, whereas the at least one permanent magnet of the other of the electromagnets is designed to exert a force on the armature insufficient to retain the armature in the associated extreme position against the springs, and wherein the at least one permanent magnet associated with the one of the electromagnets which is configured to retain the armature is placed in the form of a V in a first central branch of the associated core, wherein the associated coil is wound around the first central branch, and wherein the at least one permanent magnet associated with the other of the electromagnets is placed flat, parallel to the armature, in a second central branch of the associated core, wherein the associated coil is wound around the second central branch.

2. The actuator as claimed in claim 1, wherein in each of the electromagnets, the first central branch of the core has an end face that lies set back by an amount (h) relative to end faces of other branches of the core.

3. The actuator as claimed in claim 1, wherein the at least one permanent magnet that is configured to exert a force on the armature insufficient to retain the armature in the associated extreme position against the springs, is installed on the core of the associated electromagnet so as to be directly facing the armature.

4. A method of controlling an internal combustion engine valve, comprising using an actuator as claimed in claim 1 to operate a valve that can move between a closed position and an open position, wherein the actuator is placed relative to the valve such that:

the closed position of the valve corresponds to the extreme position of the actuating member in which the latter can be retained by the at least one permanent magnet of the corresponding electromagnet against the elastic member; and the open position of the valve corresponds to the extreme position of the actuating member in which the latter cannot be retained by the at least one permanent magnet of the corresponding electromagnet against the elastic member.

* * * * *